US009702181B1

(12) United States Patent
Kelley

(10) Patent No.: US 9,702,181 B1
(45) Date of Patent: Jul. 11, 2017

(54) DECORATIVE GARAGE DOOR INSERT SIMULATING WROUGHT IRON BUT MADE OF SPECIALLY COATED PLASTIC

(71) Applicant: Robert A. Kelley, Moreno Valley, CA (US)

(72) Inventor: Robert A. Kelley, Moreno Valley, CA (US)

( * ) Notice: Subject to any disclaimer, the term of this patent is extended or adjusted under 35 U.S.C. 154(b) by 0 days.

(21) Appl. No.: 14/929,215

(22) Filed: Oct. 30, 2015

(51) Int. Cl.
*E06B 3/58* (2006.01)
*E06B 3/54* (2006.01)

(52) U.S. Cl.
CPC ..... *E06B 3/54* (2013.01)

(58) Field of Classification Search
CPC ..... E06B 3/5892; E06B 2003/7044; B32B 17/10247; A47B 2096/207; A47B 96/201
See application file for complete search history.

(56) References Cited

U.S. PATENT DOCUMENTS 1,199,893 A * 10/1916 Smith ..... E04F 15/02 52/311.1
1,709,267 A * 4/1929 Horton ..... E06B 3/5885 52/204.61
5,123,211 A * 6/1992 Schlicht ..... E06B 3/685 29/449
5,497,588 A * 3/1996 Martin ..... E06B 3/72 52/208
5,945,180 A * 8/1999 Phillips ..... B32B 17/10247 428/14
6,272,801 B1 * 8/2001 Suh ..... E06B 3/5892 49/505
D475,469 S * 6/2003 Barnard ..... D25/60
2008/0163572 A1 * 7/2008 Lee ..... E06B 1/006 52/204.61

OTHER PUBLICATIONS www.houzz.com/photos/International-Builders-Show-2014-mediterranean-garage-doors-and -openers, 2014.*

* cited by examiner

*Primary Examiner* — Rodney Mintz
*Assistant Examiner* — Daniel Kenny
(74) *Attorney, Agent, or Firm* — Thomas I. Rozsa

(57) ABSTRACT

A decorative insert for a garage door panel comprising a multiplicity of decorative shapes, each respective decorative shape having exterior retaining taps extending transversely to an exterior surface of each decorative shape. The garage door panel includes a transparent sheet of material affixed to the back of the garage door panel by a frame member and a garage door frame is affixed to the front surface of the garage door panel with a gap between an interior surface of the garage door frame and the transparent sheet of material so that at least a portion of the retaining tabs of the decorative insert can be retained within the gap between the interior surface of the garage door panel frame and the transparent sheet of material to retain the decorative insert at spaced apart locations.

7 Claims, 9 Drawing Sheets

DECORATIVE GARAGE DOOR INSERT SIMULATING WROUGHT IRON BUT MADE OF SPECIALLY COATED PLASTIC

BACKGROUND OF THE INVENTION

1. Field of the Invention

The present invention relates to the field of garage doors and in particular to inserts for garage door panels.

2. Description of the Prior Art

The top portion of garage doors have been used for decoration for many years. It is customary in the industry of garage door manufacturing to have the top portion (approximately 10 to 20%) of the upper front surface of the garage door designed with windows or decorative styles of windows. Within the area of decorative windows for garage doors, there is a significant need for an improved cost effective wrought iron looking garage door window design that looks more realistic than what is currently available. Some of the choices look flat with no depth and have no three-dimensional (3-D) appearance. This type of design lacks curb appeal and they fade from view when appearing to a person at a leading edge of a driveway. Most of the current designs are made from acrylic seeded glass and the design is sandwiched inside, thereby giving a flat overall appearance. The process involved in manufacturing this type of design is very expensive. The cost in most cases requires it to be sold at most as much as the wholesale cost of the garage door itself. High cost and not very much curb appeal are the problems with many prior art garage door inserts.

One other important part of a high curb appeal design is a realistic black frame around the design. Most of the acrylic wrought iron designs are just a sheet of plastic placed between a window or transparent sheet of material and a frame that matches the color of the garage door panel. Manufacturers do this for a few reasons because the frames on most garage doors are made of plastic. If black plastic is used, it will usually wrap, melt or distort depending on where the door is installed such as if the garage door faces the sun or if it is located in a hot climate. Even with all of the advancements in plastics, they will still distort under high heat and direct sunlight. One reason is because the frame is rigid and must be fit very tight in the door to retain the acrylic pane retainer. Black plastic needs room to expand and contract. Plastic rigid black frames will expand and contract. They expand and contract more than metal or aluminum and that is the reason they are not used. One of the other drawbacks with the acrylic pane design is that only one type of color or textured glass design can be used for each type. Most acrylic uses obscure seeded type of glass as a standard. Currently, either the simulated wrought iron design or the obscure glass design is manufactured, not both. If the customer requests glue chip glass, white laminated or a smoked, tinted glass option, it would not be available.

The reason for this is that it is not cost efficient to inventory and manufacture all the different glass types available with the wrought iron design. The inventory would be very expensive and not knowing what would sell the best or fastest would lead to unrealistic inventory costs. Too many glass pieces and too many design options are not cost effective for a dealer or manufacturer. Using real wrought iron is not a good option either. The drawbacks are the weight and high cost. Therefore, the current options are very expensive and do not provide the options and cost effective choices for homeowners, consumers, and garage door dealer distributers. Thus, there is a strong need for improvement in the field of garage doors decorative inserts.

SUMMARY OF THE INVENTION

The present invention is a decorative insert having a multiplicity of different shapes which include retaining tabs that fit inside a gap between a window pane of a garage door and the frame of the garage door. Each decorative insert is designed with innovative spaced apart retaining tabs that are molded or are otherwise formed into the decorative insert. The spaced apart retaining tabs enable the decorative insert to be retained in the gap at spaced apart locations and do not require that the decorative insert totally encircle the interior circumference of the garage door frame. These inserts have decorative designs that have the appearance of being wrought iron.

It is an object of the present invention to have a metal frame inserted and replacing each of the window panels of a garage door. Once these frames are inserted, an elegant plastic mold that resembles wrought iron can be inserted into a gap between each respective metal frame and a respective transparent sheet affixed to a rear of the respective garage door panels.

It is an additional object of the present invention to have specifically designed retaining tabs that fit underneath each edge of the panel. It is also an object of the present invention to have a multiplicity of different metal frames and a multiplicity of different molded inserts which correspond to variously sized garage door window panels.

It is an additional object of the present invention to have an aluminum powder coated frame located adjacent the retaining tabs which provide additional stability to the inserts. The innovative tabs coupled with the aluminum powder coated frame provide stability when the garage door is in motion.

It is an additional object of the present invention to bring extreme curb appeal to the garage door's upper row of panels. The garage door inserts of the present invention are realistic looking from up close or from a distance. This invention will reduce the cost of manufacturing and provide depth from far away by having a 3-D appearance. This is an improvement over the prior art where the designs often look flat or painted. The current invention features tabs that are molded as one piece to thick plastic that appears to be heavy textured wrought iron.

Black colored plastic thick heavy gauge with a post UV coating provides continuous weatherability and durability. The elegant iron design is manufactured similar to a standard garage door window insert design, the difference being that the elegant iron design is not retained with a continuous supporting trim lip around the decorative insert. Most garage door inserts of which the present inventor is aware are primarily made so that they are able to snap in from the outside on a garage door window frame. The thin 0.040-0.045 inch thickness needs more support to hold it in and prevent it from distorting. These designs are molded with a continuous recessed lip all the way around the design/insert. This way they can be inserted from the outside and held in place by the door window frame. The entire design is made to be supported from all sides and is one connected rigid piece.

The preferred method of manufacturing of the present invention elegant iron design would be vacuum forming. Plastic injection molding an also be used to produce the design. However, vacuum forming is a more cost effective method. The elegant iron design is not supported from a continuous lip ring/flange. The elegant iron appearing design uses heavy plastic that is twice as thick as most garage door inserts. This combined with the molded hammered look in the tooling provides the finished part with more strength because of the rough uneven texture which makes it very rigid and strong. Another source of strength for the present invention is the way the finished part is cut/formed. Instead of trimming all the way to the body, the present invention design specifically creates at least a ⅛ inch flat return shelf that is left on purpose. Having extra material acts as a stiffener and overall strength is increased. This improves the stability of the design to lay flat and not twist. There is no need for a gully connection which a standard garage door insert uses. The finger/tab retaining method allows the elegant/iron appearing design to expand and contract without distorting because it can be a loose fit and still be retained, unlike a standard garage door insert.

It is a further object of the present invention to provide an aluminum powder coated frame which gives a finishing realistic touch to the entire design. To the best of the present inventor's knowledge, prior art plastic frames will expand and distort. The aluminum powder coated frame system provides benefits that the acrylic all-in-one systems cannot provide. At least an underside of the garage door frame facing the transparent sheet of material and located adjacent the gap between the underside of the garage door window frame and the transparent sheet of material will be made of powder coated aluminum. One benefit is that the elegant iron design fits into the front of the frame and is retained and held in place on the outside. This allows a custom glass type to be chosen pursuant to the customer's needs and desires.

It is a further object of the present invention to provide numerous design possibilities without prefabrication. One such design could be a wrought iron look on the front with tinted white laminated type glass behind the design. The is only an example of many choices that can be used.

It is a further object of the present invention to provide a number of options for the materials that surround the molded inserts. Users can select numerous types of colored or textured glass that can be used in conjunction with the molded inserts. Prior to this innovation, aesthetics such as wrought iron panels for garage doors had to be pre-ordered and prefabricated specifically for each use. This was done based on the numerous different design options. With the current innovation, a distributor can have in inventory various wrought iron appearance shapes and various colored glass that can be used interchangeably when installed. Prior to the present invention the distributor would have to order from the manufacturer the specific wrought iron, specific glass type, and specific panel size requested, and then ship the panel prefabricated for installation. With the current invention, the distributor can keep a multiplicity of different elements of the design and use these elements interchangeably as needed. These elements for the aluminum powder coated frame system include the color of the glass, the design of the thick plastic molded to appear like wrought iron and the size of the panels.

It is still a further object of the present invention to provide an aluminum powder coated frame system that can withstand a wide range of temperatures, is durable, light weight, and cost effective for consumers, distributors and manufacturers.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
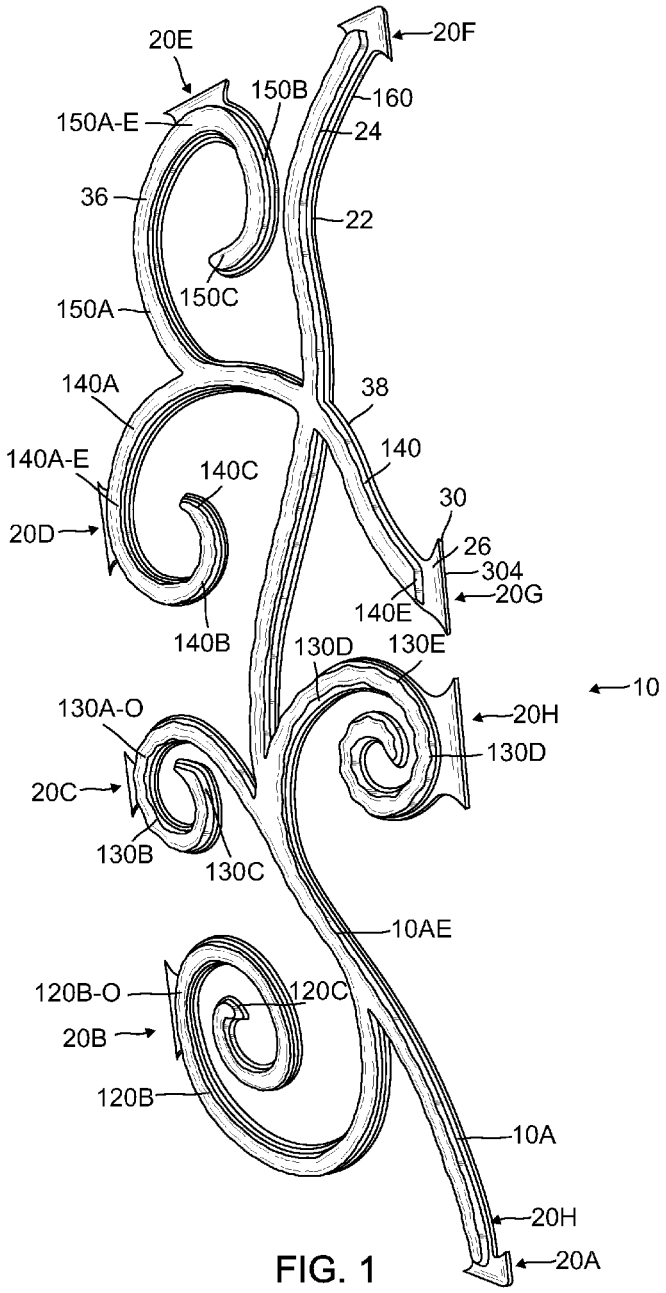
FIG. 1 is a front perspective view of one embodiment of the present invention illustrating a decorative insert given the appearance of a wrought iron insert with the present invention tabs at locations spaced apart location on the decorative insert.
Figure 9:
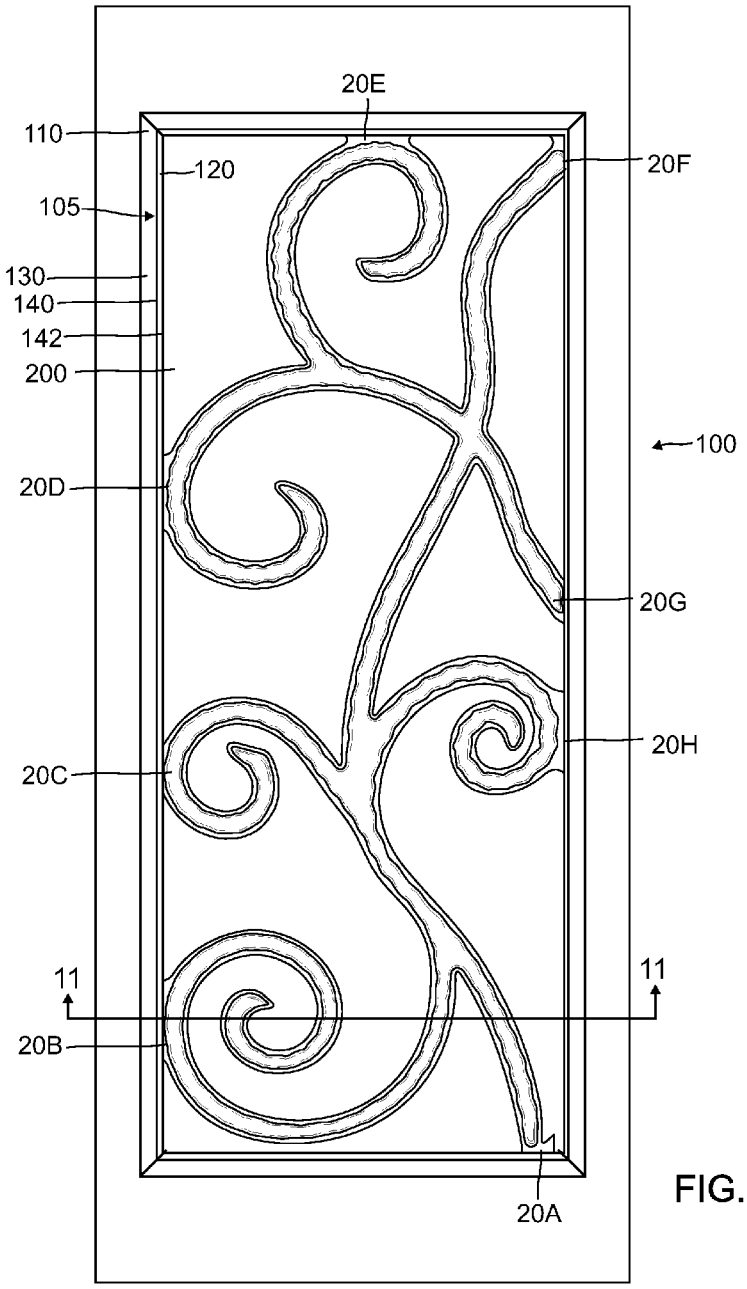
FIG. 9 is a perspective view when viewed from the outside illustrating the decorative insert inserted into a garage door panel where the frame is illustrated in dotted lines and the window is inserted behind it in dotted lines.

Referring to FIGS. 1 and 9, there is illustrated an embodiment for a garage door window insert 10, formed from plastic. The formed plastic will be a precast mold of a decorative design with elements such as circular swirls and curves as shown in FIG. 1. The current invention however, is for the inclusion of precast tabs that are integrally formed to a decorative design such as the preferred embodiment shown as garage door window insert 10 in FIG. 1.

An embodiment of the present invention is illustrated in FIGS. 1 through 8 before it is inserted into the garage door panel and the components will be identified by number. The swirls are optional with the design, but the important portion is that they have tabs at the location of each swirl or insert or an arrow design which enables the end of the insert to be inserted into the panel of the garage door. Specifically, referring to FIG. 1 through 8, the swirl design has the following components with specific decorative tabs or arrows extending from the swirl design. Looking from left to right in FIG. 1, the first component which is listed as 10A is an elongated portion which is inserted into a corner location of the garage door panel. The second component is a first swirl identified as 10B having an arcuate art design extending from an end 10A-E of component 10A and extending in an outward swirl design 120B curling back on itself and terminating at a tip 120C. The outmost inner portion of 120B designated as 120B-O contains a first insert 120C extending transversely to portion 120B-O which insert can be inserted into the gap between the garage door panel and the acrylic backing. The decorative design extends to a pair of oppositely arcuate swirls with a first arcuate swirl 130A extending to an outermost section 130A-O and extending to an inward extending swirl 130B and extending to an arcuate tip 130C. The outermost section 130A-O contains a second insert 20C that is inserted in the gap between the window and the garage door frame. There is also an oppositely designed swirl 130D which includes an arcuate section 130E and an outermost section 130E-O terminating at an arcuate tip 130D. This portion of the insert also includes a tab labeled 130H which is placed into an opposite location in the gap between the window and the garage door frame.

The decorative insert further extends to a pair of mating arcuate swirls which are numbered 140A and 140B. An exterior most portion of arcuate swirl 140A-E extends to a curved portion 140B which in turn extends to a tip 140C. The outermost portion of 140A-E terminates in an insert 20D which is inserted into the gap between the window and the garage door frame.

The swirl 140A also extends to a mirror image second section 150A, which further extends to an arcuate end section 150A-E and ending in a tip 150C. Outermost section 150A-E contains a tab 20E which is inserted into the gap between the window and the garage door frame.

The decorative insert further extends to a last section 160 which terminates at a corner end tab 20F which is inserted into the gap between the window and the garage door frame.

It will be appreciated that the swirls and tabs shown in FIG. 1 are just one variation of the decorative swirls that can be used with the present invention. Further, the invention as described has the components of a top surface 24, a first side 22, a second side 36, and a bottom 38. Because the components are the same, only the innovative tab sections 20A, 20B, 20C, 20D, 20E, 20F, 20G, and 20H are discussed in detail.

FIG. 9 is a front perspective view illustrating the tabs of the decorative insert 10 placed into a gap 120 between an interior surface of the garage door frame 110 and a transparent sheet of material 200 retained against the rear wall of the garage door panel. The various inserts include 20A, 20B, 20C, 20D, 20E, 20F, 20G, and 20H.

Figure 10:
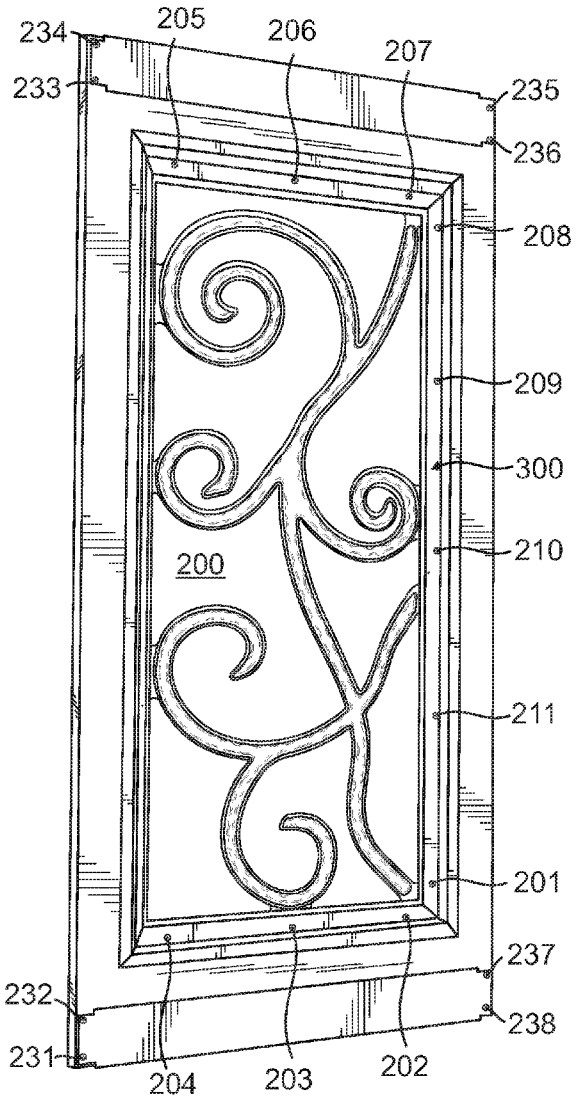
FIG. 10 is a perspective view when viewed from the inside of the garage of the decorative insert inserted into a garage door panel where the frame is illustrated in dotted lines and the window is inserted behind it in dotted lines.

FIG. 10 is a rear elevational view showing a transparent member 200 which is affixed through frame 300 by screws 201, 202, 203, 204, 205, 206, 207, 208, 209, 210, and 211. Also shown in FIG. 10 are screws 231, 232, 233, 234, 235, 236, 237, and 238 which serve to affix the frame 300 retaining the transparent member 200 against a rear surface of the garage door panel.

Figure 11:
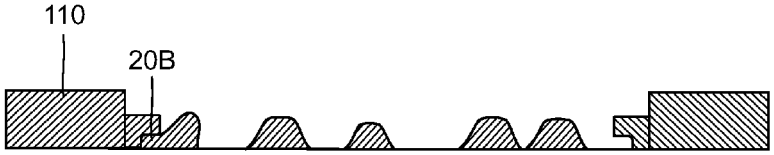
FIG. 11 is a cross sectional view of a decorative insert illustrated in FIG. 10

FIG. 11 as illustrated is a cross-sectional view of FIG. 10.

Figure 2:
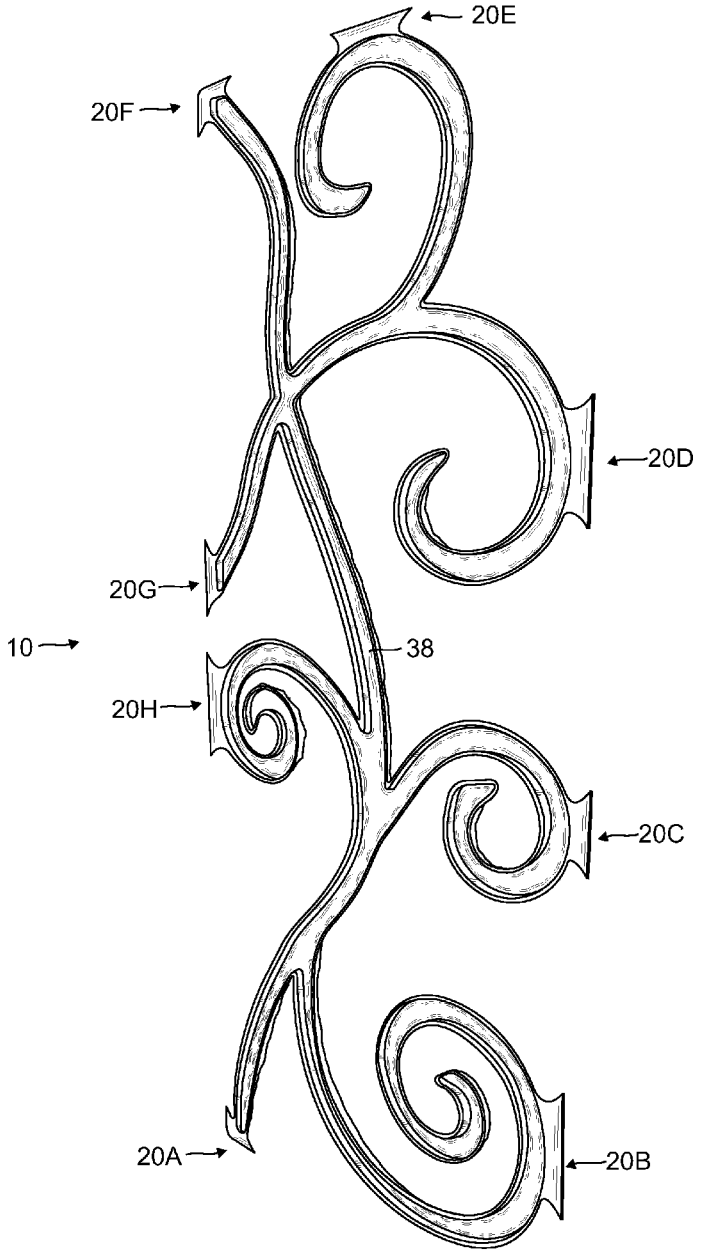
FIG. 2 is a bottom perspective view of a decorative insert illustrated in FIG. 1.
Figure 3:
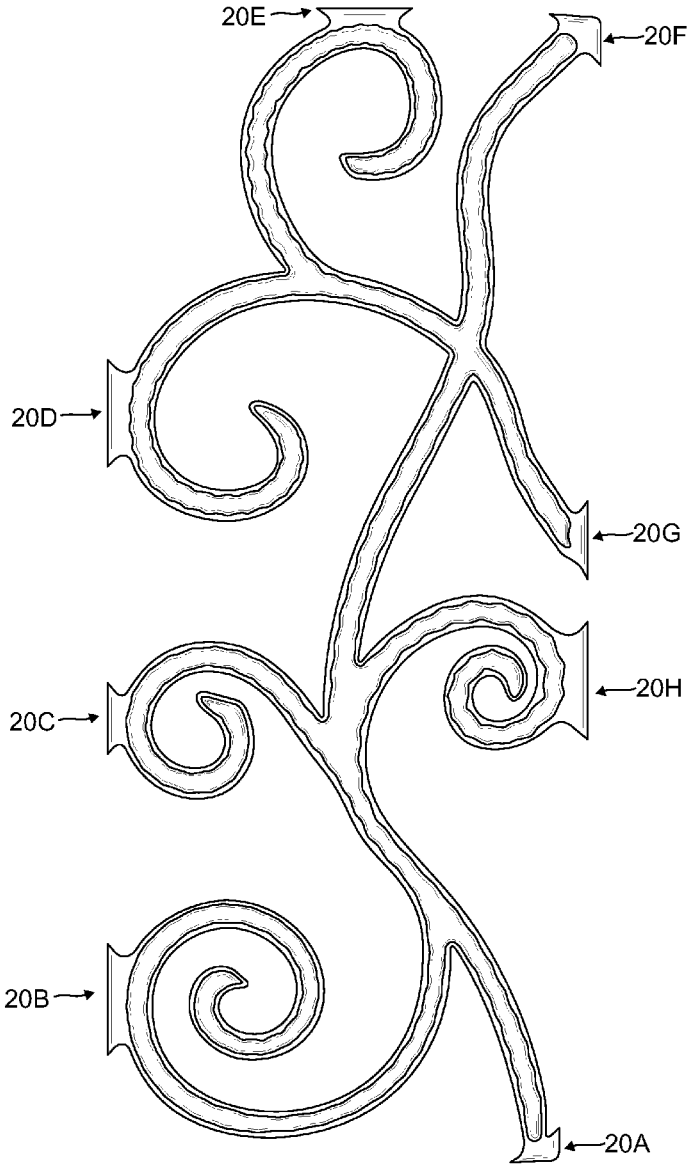
FIG. 3 is a front elevational view of the present invention decorative insert as identified in FIG. 1.
Figure 4:
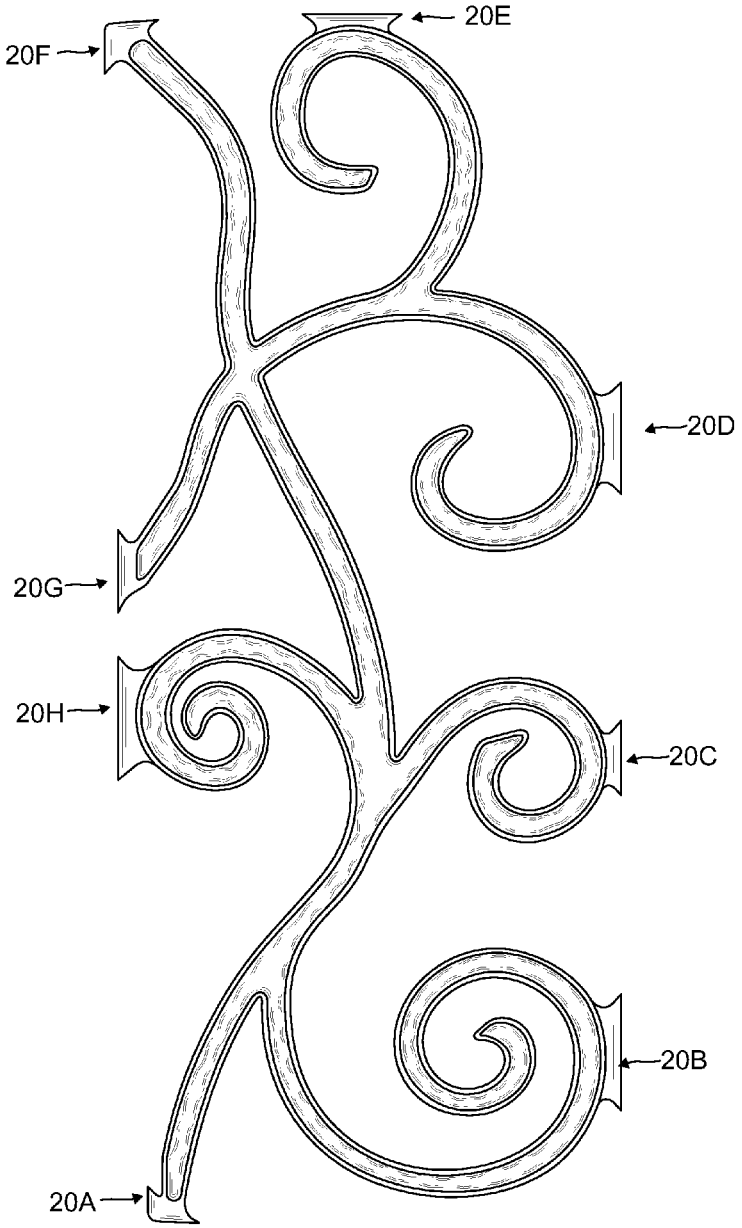
FIG. 4 is a rear perspective view of the decorative insert identified in FIG. 1 when viewed from a glass panel which is set forth in dotted lines preferred embodiment of the invention.
Figure 5:
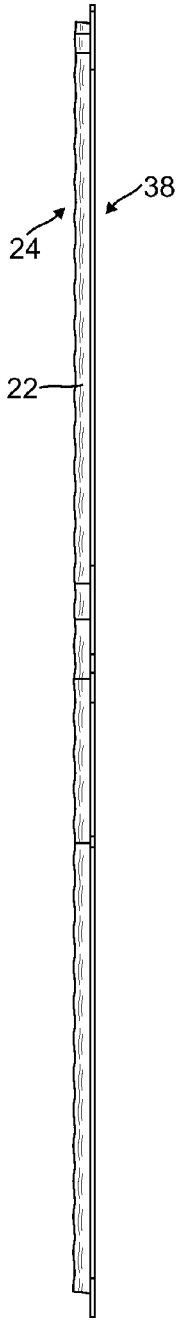
FIG. 5 is a right side elevational view of the decorative insert illustrated in FIG. 1.
Figure 6:
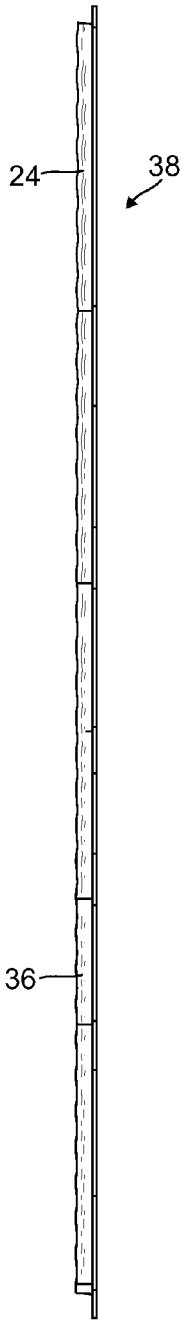
FIG. 6 is a right side elevational view of the decorative insert illustrated in FIG. 1.
Figure 7:
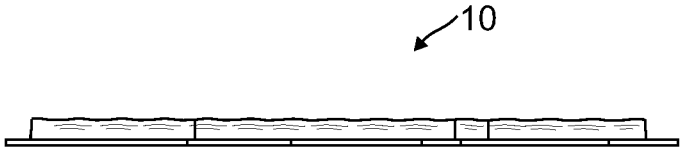
FIG. 7 is a top plan view of the decorative insert illustrated in FIG. 1.
Figure 8:
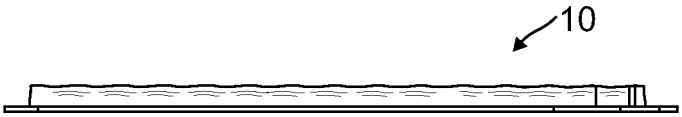
FIG. 8 is a bottom plan view of the decorative insert in FIG. 1.

Garage door window insert 10 is further illustrated in FIG. 2 to have retaining tabs 20A through 20H. Each of these retaining tabs 20A through 20H are designed to fit within the gap between the transparent sheet of material 200 and the interior surface of the garage window frame 110. Tabs 20A through 20H will serve to function equally by retaining garage door window insert 10 to frame 110. Each of these tabs found on the embodiment shown in FIG. 1 or another embodiment not directly shown will have either corner tabs such as 20A and 20F in FIG. 1, side wall tabs such as 20B, 20C, 20D, 20G, and 20H in FIG. 1, or end wall tabs such as 20E in FIG. 1.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

What is claimed is:

1. An insert to be used in conjunction with a garage door panel having a transparent sheet of material having a given circumference and retained against a rear surface of the garage door panel, and a frame incorporated into a front surface of the garage door panel, the frame having a circumferential wall with an interior surface aligned with the given circumference of the transparent sheet of material, a circumferential gap between the frame circumferential wall and the given circumference of the transparent sheet of material, the insert comprising:

a. a multiplicity of swirls, at least a portion of the multiplicity of swirls having an outer edge adjacent the frame circumferential wall, each of said at least a portion of the multiplicity of swirls including an integral retaining tab extending away from a respective outer edge and spaced apart from each respective integral retaining tab;

b. each integral retaining tab located at a discreet separate location from any adjacent integral retaining tab with no retaining tab touching any other retaining tab;

c. each respective integral retaining tab selected from the group consisting of: a tab having an arcuate extension extending to a flat insertion member and an elongated extension terminating in an arrow;

d. each respective retaining tab inserted into the gap between the transparent sheet of material and the interior surface of the circumferential frame wall at selected spaced apart locations, each respective integral retaining tab inserted into said circumferential gap to facilitate the respective integral retaining tab retained between the transparent sheet of material and the interior surface of the circumferential frame wall;

e. the insert made of heavy gauge plastic and colored black to simulate heavy textured wrought iron;

f. the insert has a UV coating exterior; and g. at least the interior surface of the frame circumferential wall made of powder coated aluminum;

h. whereby, each respective integral retaining tab inserted into a separate location within the gap between the frame and the interior surface of the circumferential frame and the transparent sheet of material enables the insert to be removed and replaced with alternative inserts and further enables each insert to expand and contract based upon weather conditions since each respective integral retaining tab is not in one uniform location but instead each respective integral regaining tab is spaced apart from each other respective integral retaining tab to facilitate expansion and contraction of the insert.

2. An insert to be used in conjunction with a garage door panel having a sheet of material having a given circumference and retained against a rear surface of the garage door panel, and a frame incorporated into a front surface of the garage door panel, the frame having a circumferential wall with an interior surface aligned with the given circumference of the sheet of material, a circumferential gap between the frame circumferential wall and the given circumference of the sheet of material, the insert comprising: a multiplicity of swirls, at least a portion of the multiplicity of swirls having an outer edge adjacent the frame circumferential wall, each of said at least a portion of the multiplicity of swirls including an integral retaining tab extending away from a respective outer edge and spaced apart from each respective integral retaining tab, each respective integral retaining tab inserted into said circumferential gap to facilitate the respective integral retaining tab retained between the sheet of material and the interior surface of the circumferential frame wall, a selected group of said integral retaining tabs having an elongated extension terminating in an arrow, which arrow is inserted into a location in the gap between the sheet of material and the interior surface of the circumferential frame wall at selected spaced apart locations.

3. The insert in accordance with claim 2, further comprising: the insert is made of heavy gauge plastic and colored black to simulate heavy textured wrought iron.

4. The insert in accordance with claim 2, further comprising: the insert has a UV coating exterior.

5. The insert in accordance with claim 2, further comprising: at least the interior surface of the frame circumferential wall made of powder coated aluminum.

6. The insert in accordance with claim 2, further comprising: each said integral retaining tab is formed from the same material as the decorative insert.

7. The insert in accordance with claim 2, further comprising: said sheet of material is made from group consisting of: acrylic, stained glass, seeded glass, laminated glass, textured glass and tinted glass.

* * * * *